US007534140B2

(12) United States Patent
Zheng et al.

(10) Patent No.: US 7,534,140 B2
(45) Date of Patent: May 19, 2009

(54) ELECTRICAL CONNECTOR WITH IMPROVED METAL SPRING

(75) Inventors: Qi-Sheng Zheng, Kunshan (CN); Jia-Yong He, Kunshan (CN); Zhong-Hua Yao, Kunshan (CN); Wen-Yu Liu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/894,126

(22) Filed: Aug. 20, 2007

(65) Prior Publication Data

US 2008/0045086 A1 Feb. 21, 2008

(30) Foreign Application Priority Data

Aug. 18, 2006 (CN) ..... 200620077169.8

(51) Int. Cl.
*H01R 13/648* (2006.01)

(52) U.S. Cl. ..... 439/607

(58) Field of Classification Search ..... 439/607, 439/70, 71

See application file for complete search history.

(56) References Cited

U.S. PATENT DOCUMENTS 7,077,663 B2 7/2006 Nishio et al.
7,077,664 B1 * 7/2006 Wang et al. ..... 439/70
7,086,902 B1 * 8/2006 Yang ..... 439/607
7,112,083 B2 * 9/2006 Nishio et al. ..... 439/331
7,121,864 B1 * 10/2006 Yang ..... 439/331
7,128,607 B2 * 10/2006 Li ..... 439/607
7,147,481 B2 * 12/2006 Yang ..... 439/71
7,214,083 B2 * 5/2007 Chen et al. ..... 439/330
7,241,160 B2 * 7/2007 Yang ..... 439/330
7,288,003 B2 * 10/2007 Ono et al. ..... 439/607
7,309,238 B2 * 12/2007 Yang ..... 439/71
2005/0048829 A1 * 3/2005 Nishio et al. ..... 439/331
2006/0063431 A1 * 3/2006 Yang ..... 439/607
2006/0105631 A1 * 5/2006 Yang ..... 439/607
2006/0234557 A1 * 10/2006 Chen ..... 439/609
2007/0207653 A1 * 9/2007 Ono et al. ..... 439/188
2007/0232143 A1 * 10/2007 Yang ..... 439/607
2008/0014797 A1 * 1/2008 Yang ..... 439/607
2008/0032553 A1 * 2/2008 Wang ..... 439/607
2008/0045070 A1 * 2/2008 Zheng et al. ..... 439/370
2008/0119080 A1 * 5/2008 Wu ..... 439/331
2008/0166921 A1 * 7/2008 Ma ..... 439/638
2008/0176459 A1 * 7/2008 Ma ..... 439/741

FOREIGN PATENT DOCUMENTS

TW M272251 8/2005

* cited by examiner

*Primary Examiner*—Ross N Gushi
(74) *Attorney, Agent, or Firm*—Wei Te Chung

(57) ABSTRACT

An electrical connector (100) for receiving a camera module (5) includes an insulative housing (1), a number of contacts (2) retained in the insulative housing, a pair of metal springs (3) and a metal shield (4) covering the insulative housing. The insulative housing (1) includes four continuous walls (11, 12, 13, 14) with a receiving chamber (10) formed therebetween for accommodating the camera module (5) therein. Each metal spring (3) includes a retaining portion (31) secured in one of the four walls and a pair of spring arms (32, 33) extending from an edge (311) of the retaining portion and extending into the receiving chamber for abutting against the camera module.

20 Claims, 4 Drawing Sheets

ELECTRICAL CONNECTOR WITH IMPROVED METAL SPRING

BACKGROUND OF THE INVENTION

1. Field of the Invention

The present invention relates to electrical connectors, and more particularly to an electrical connector with improved metal springs for abutting against an electronic module accommodated in the electrical connector.

2. Description of Related Art

With development trend of miniature and multifunctional electronic devices, consumer electronic devices such as cell phones, personal digital assistants etc., are designed to provide camera module for capturing pictures. Accordingly, there is a demand employing socket connectors for connecting the camera module to the consumer electronic devices.

U.S. Pat. No. 7,086,902 B1, issued on Aug. 8, 2006, discloses such a conventional socket connector. The socket connector comprises an insulative housing, a plurality of contacts retained in the insulative housing and a metal shield enclosing the insulative housing to form a chamber for receiving a camera module therein. The plurality of contacts comprise a plurality of contact portions protruding into the chamber. The metal shield comprises a pair of opposite shielding walls each of which comprises three engaging arms integrally bending from an edge thereof and extending into the chamber for holding the camera module received in the chamber. However, since the engaging arms are long and integrally bend from the metal shield, the structure of the metal shield is complex and difficult in manufacture.

Hence, an improved electrical connector is desired to overcome the above problems.

BRIEF SUMMARY OF THE INVENTION

It is an object of the present invention to provide an electrical connector with simple structure adapted for securely receiving an electronic module therein.

In order to obtain the object above, an electrical connector for receiving an electronic module therein comprises an insulative housing, a plurality of contacts retained in the insulative housing, at least one metal spring and a metal shield covering the insulative housing. The insulative housing includes four continuous walls with a receiving chamber formed therebetween for accommodating the camera module therein, and a rear wall at a rear side of the receiving chamber. The plurality of contacts are retained in the rear wall of the insulative housing with a plurality of contact portions cantileveredly extending into the receiving chamber for electrically mating with the electronic module. The metal spring comprises a retaining portion retained in one of the four continuous walls and a pair of spring arms bending from an edge of the retaining portion and protruding into the receiving chamber for elastically abutting against the electronic module. The metal spring is separated with respect to the metal shield, thereby simplifying the structure of the metal shield. As a result, both of the metal shield and the metal spring are easily to be manufactured.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
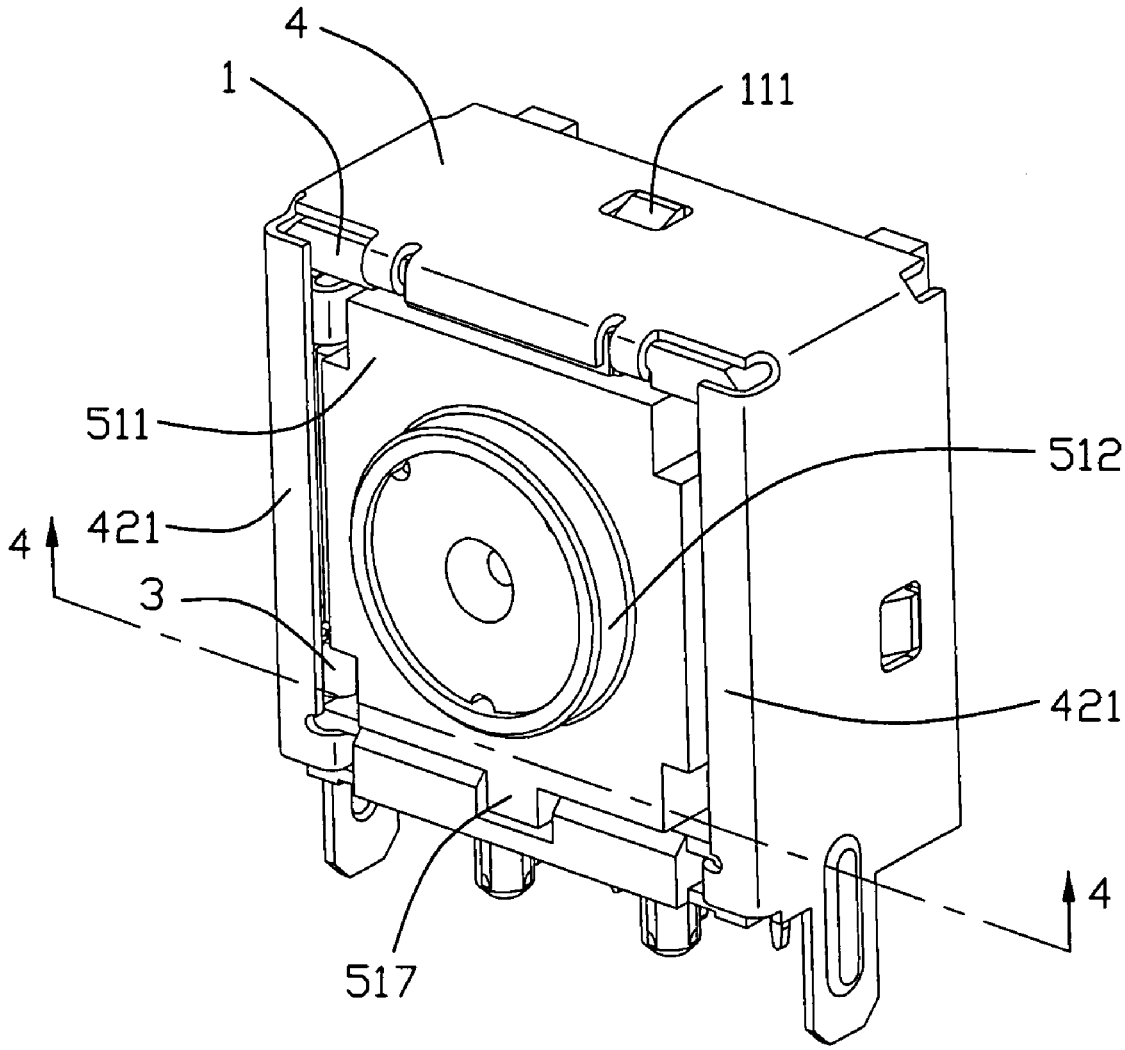
FIG. 1 is a perspective view of an electrical connector assembly with an electronic module received in an electrical connector.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1-4, an electrical connector 100 according to the preferred embodiment is applicable to a mobile handset (not shown) for electrically receiving an electronic module (such as a camera module 5) thereinto. The electrical connector 100 includes a rectangular insulative housing 1, a plurality of contacts 2 retained in the insulative housing 1, a pair of metal springs 3 and a metal shield 4 covering the insulative housing 1.

The insulative housing 1 comprises four continuous walls with a receiving chamber 10 formed therebetween and a rear wall 15 at the rear of the receiving chamber 10. The four continuous walls include a first side wall 13, a second side wall 14 opposite to the first side wall 13, a top wall 11 and a bottom wall 12. The top wall 11 connects upper edges of the first and second side walls 13 and 14. The bottom wall 12 connects lower edges of the first and second side walls 13 and 14. The top wall 11 comprises a protrusion 111 on an outer surface thereof for mating with the metal shield 4. The bottom wall 12 defines a recess 121 in an inner surface thereof. The recess 121 communicates with the receiving chamber 10 for mating with a corresponding protrusion 517 formed on the camera module 5 so that the camera module 5 can be correctly received in the receiving chamber 10. The bottom wall 12 is mounted to a circuit board (not shown) of the mobile handset through a plurality of posts 123 which extend downwardly from the bottom wall 12. The first side wall 13 defines a first slit 131 for retaining one of the metal spring 3 and a pair of first recesses 132 formed in an inner surface thereof. The pair of first recesses 132 are located on opposite sides of the first slit 131 along a vertical direction and communicate with the receiving chamber 10. The second side wall 14 is of the same configuration as the first side wall 13. The second side wall 14 defines a second slit 141 for retaining the other metal spring 3 and a pair of second recesses 142 formed in an inner surface thereof. The pair of second recesses 142 are located on opposite sides of the second slit 141 along the vertical direction and communicate with the receiving chamber 10. The rear wall 15 and the bottom wall 12 define a plurality of passageways 151, 124, respectively, for receiving the contacts 2.

Figure 2:
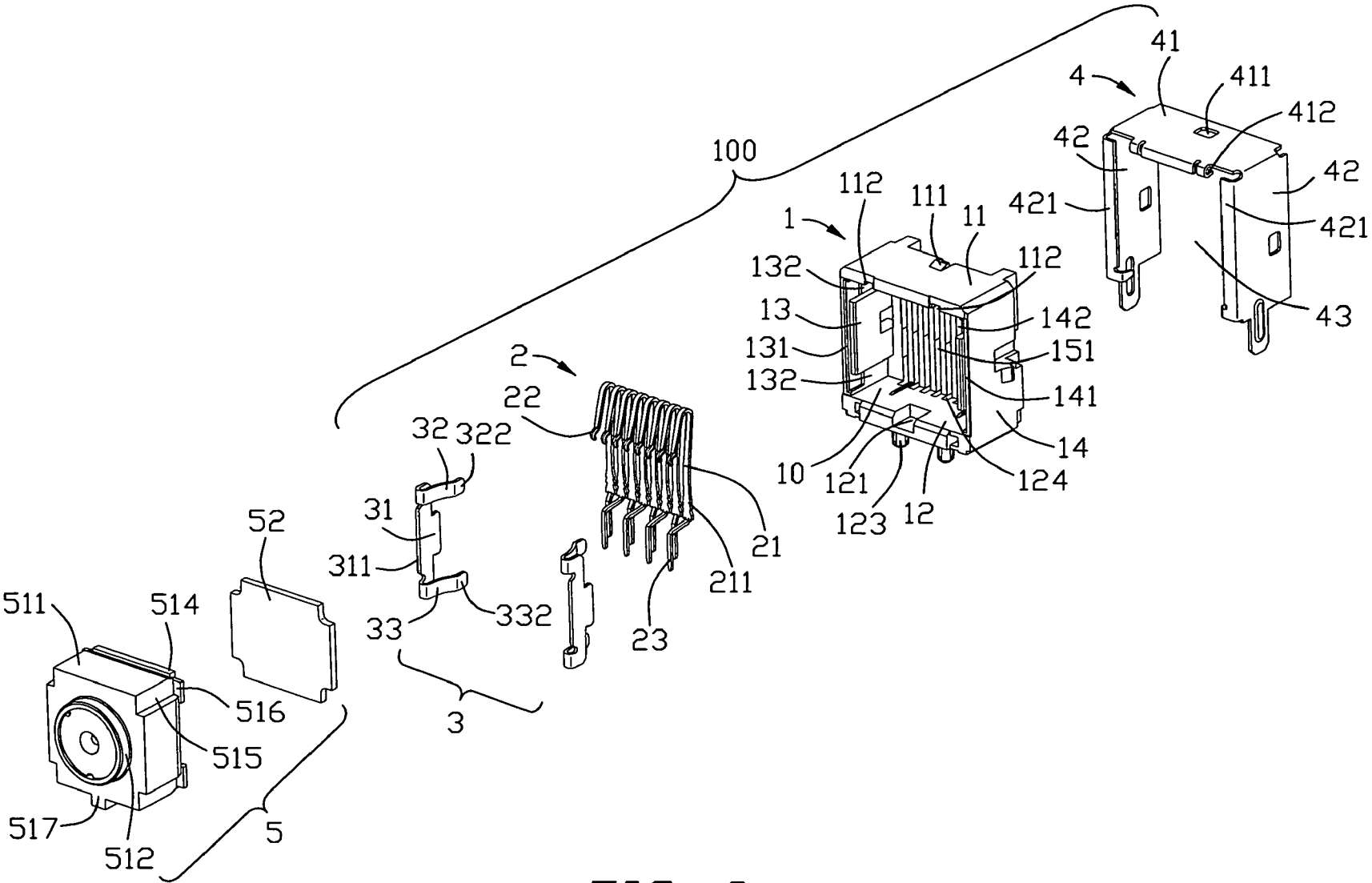
FIG. 2 is an exploded perspective view of the electrical connector assembly.
Figure 3:
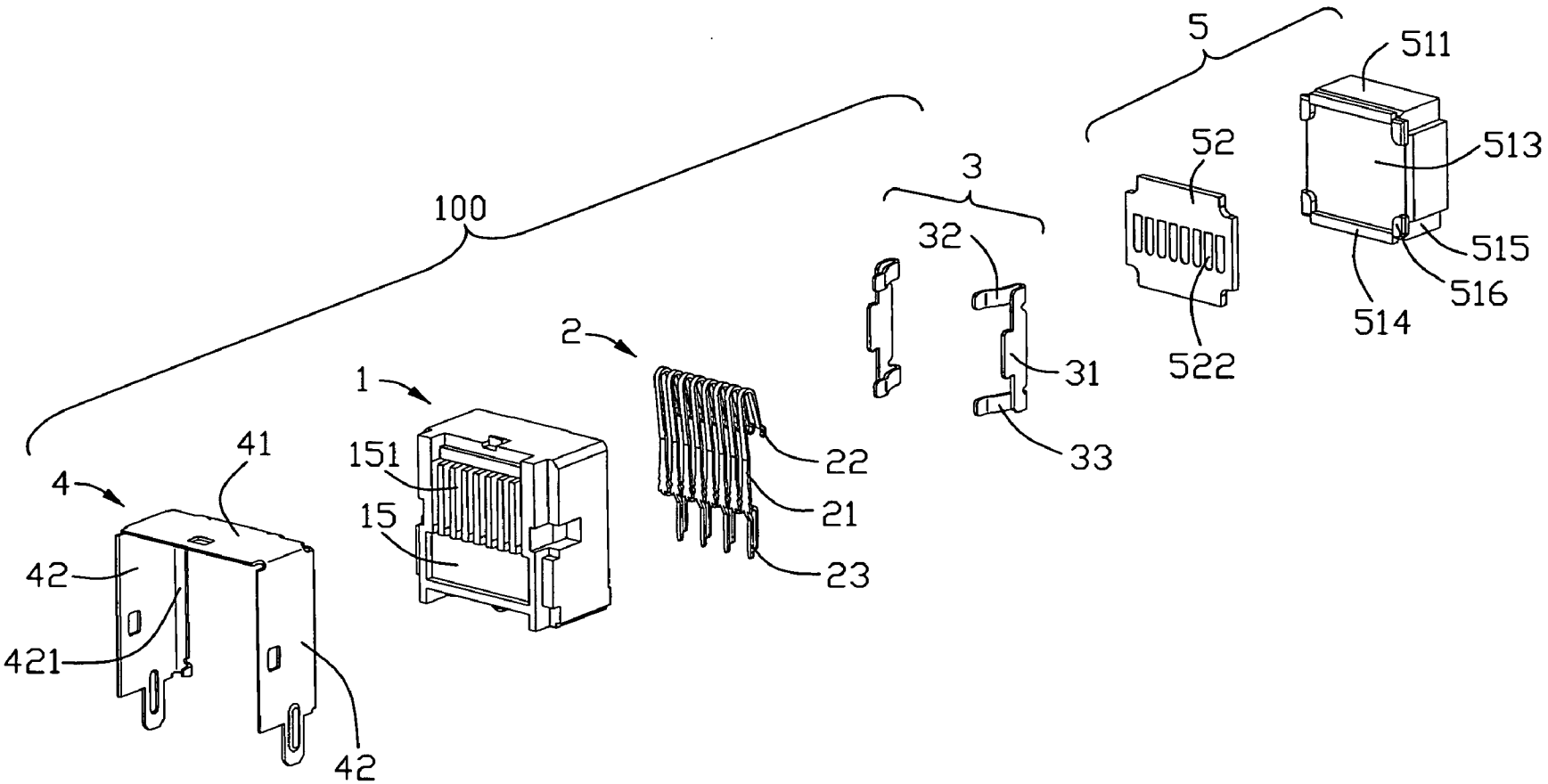
FIG. 3 is another exploded view similar to FIG. 2, but viewed from another aspect.

Referring to FIGS. 1-3, the contacts 2 are received in the corresponding passageways 151, 124 from a lower-to-upper direction. Each contact 2 comprises a body 21, an elastic contact portion 22 bending downwardly from one end of the body 21 and a L-shaped tail 23 extending from the other end of the body 21. The body 21 comprises a plurality of barbs 211 so that the contacts 2 can be stably retained in the insulative housing 1. The contact portion 22 of each contact 2 cantileveredly extends into the receiving chamber 10 for electrically connecting with the camera module 5.

Regarding FIG. 3, the pair of metal springs 3 are of the same configuration each of which comprise a vertical retaining portion 31 and a pair of spring arms 32, 33 bending from an edge 311 of the retaining portion 31. The spring arms 32, 33 are located on top and bottom sides of the retaining portion 31. Each spring arm 32, 33 comprises a distal end 322, 332 for abutting against the camera module 5.

The metal shield 4 is stamped from an integral metal sheet and comprises a top face 41, a pair of side faces 42 extending downwardly from lateral edges of the top face 41 and a cavity 43 disposed between the side faces 42. The top face 41 defines a receiving hole 411 for receiving the protrusion 111 of the insulative housing 1. A plurality of hooks 412 bend from a front edge of the top face 41 and extend backwardly into the cavity 43. When the metal shield 4 is assembled to the insulative housing 1, the hooks 412 are received in corresponding apertures 112 recessed in the top wall 11 of the insulative housing 1. Each side face 42 further has a holding plate 421 bending laterally from a front edge thereof and substantially perpendicular to the side face 42. When the metal shield 4 is assembled to enclose the insulative housing 1, the holding plates 421 of the side faces 42 press the metal springs 3 to prevent the metal springs 3 from falling off from the insulative housing 1. The metal springs 3 are separated with respect to the metal shield 4, thereby simplifying the structure of the metal shield 4. As a result, both of the metal shield 4 and the metal spring 3 are easily to be manufactured. Besides, since the metal springs 3 are of simple configuration and stable to be mounted, it is easy that all of the spring arms 32, 33 occur a same elasticity with insertion of the camera module 5 in order to provide excellent mounting precision.

The camera module 5 includes a base portion 511, a column lens portion 512 protruding from the base portion 511 and a circuit board 52 attached to a rear side 514 of the base portion 511. The rear side 514 defines a depression 513 to receive the circuit board 52 so that the circuit board is coplanar with the rear side 514 of the base portion 511. The circuit board 52 comprises a plurality of conductive pads 522 as shown in FIG. 3. The base portion 511 comprises four locking plates 516 formed on four corners of the rear side 514 and four guiding grooves 515 corresponding to the four locking plates 516.

Figure 4:
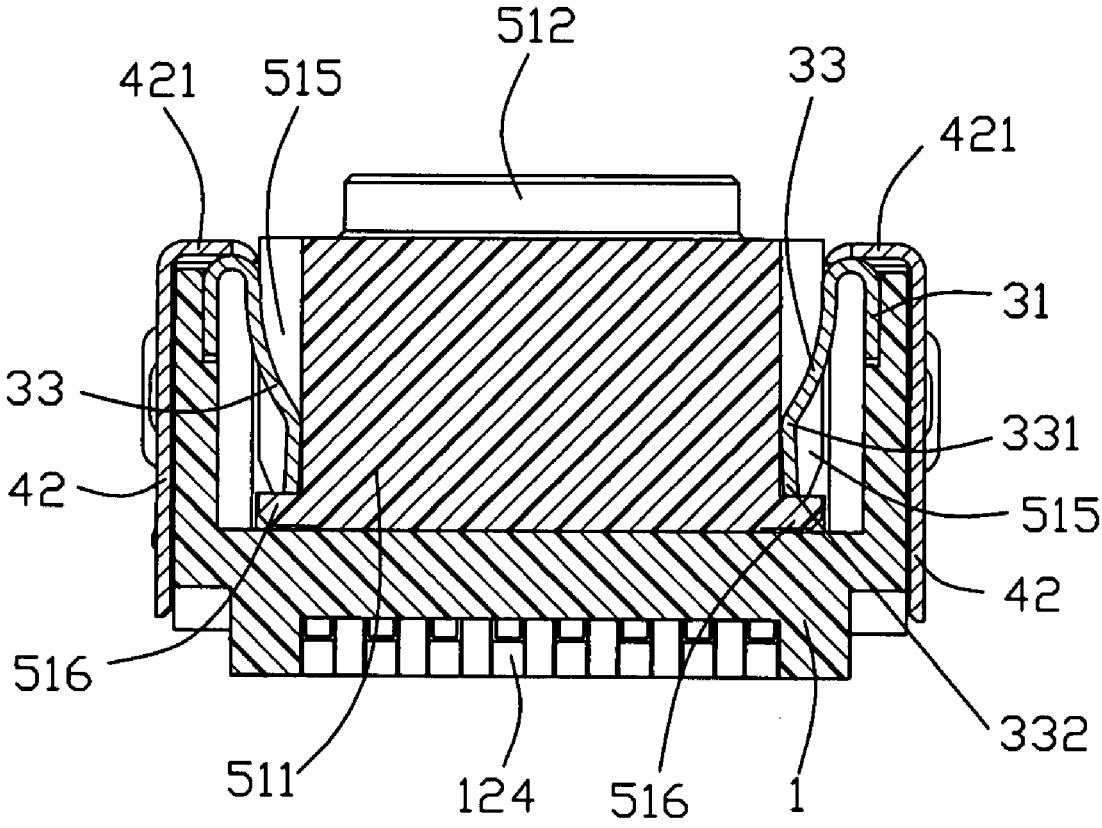
FIG. 4 is a cross-sectional view of the electrical connector assembly taken along line 4-4 of FIG. 1.

When the camera module 5 is inserted into the receiving chamber 10 of the insulative housing 1, the locking plates 516 abut against the spring arms 32, 33 of the metal springs 3 to make the spring arms 32, 33 accommodated in the corresponding first and second recesses 132, 142. After the camera module 5 is inserted into a rear end of the receiving chamber 10, the contact portions 22 of the contacts 2 attach the conductive pads 522 of the circuit board 52. Meanwhile, the spring arms 32, 33 resume their elasticity to be located in the guiding grooves 515. The distal ends 322, 332 of the spring arms 32, 33 abut against the locking plates 516 as best shown in FIG. 4 so that the camera module 5 can't fall off from the receiving chamber 10.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector for receiving an electronic module therein, comprising:

an insulative housing comprising a first side wall, a second side wall with a receiving chamber formed therebetween for accommodating the electronic module therein, and a rear wall at a rear of the receiving chamber;

a plurality of contacts retained in the insulative housing, each contact comprising an elastic contact portion cantileveredly extending into the receiving chamber; and at least one metal spring secured to the insulative housing, the metal spring comprising a retaining portion retained in the first side wall of the insulative housing and a pair of spring arms bending inwardly from an edge of the retaining portion, each spring and comprising a distal end opposite to the edge of the retaining portion and protruding into the receiving chamber for elastically abutting against the electronic module; wherein an inner surface of the first side wall defines a pair of recesses corresponding to the pair of spring arms, the recesses being in communication with the receiving chamber for the pair of spring arms movable therein.

2. The electrical connector according to claim 1, wherein the spring arms extend from opposite ends of the retaining portion to the rear wall.

3. The electrical connector according to claim 1, wherein the first side wall defines a slit to receive the retaining portion of the metal spring.

4. The electrical connector according to claim 1, wherein further comprising another metal spring which has another retaining portion retained in the second side wall of the insulative housing and a pair of another spring arms bending inwardly from an edge of the another retaining portion, each another spring arm comprising a distal end opposite to the edge of the another retaining portion and protruding into the receiving chamber for elastically abutting against the electronic module.

5. The electrical connector according to claim 1, wherein the insulative housing is squared shaped and comprises a top wall connecting top ends of the first and second side walls, and a bottom wall connecting bottom ends of the first and second side walls.

6. The electrical connector according to claim 5, wherein further comprising a metal shield covering the insulative housing, the metal shield comprising atop face attached to the top wall of the insulative housing and a pair of side faces extending downwardly from lateral edges of the top face to abut against the first and second side walls of the insulative housing, and wherein one of the side face comprises a holding plate bending laterally from a front edge thereof to abut against the metal spring.

7. The electrical connector according to claim 5, wherein the plurality of contacts are assembled to the insulative housing from a lower-to-upper direction, each contact comprising a body received in the rear wall and a tail extending from one end of the body, and wherein the contact portion of each contact bends downwardly from the other end of the body.

8. An electrical connector assembly, comprising:

an electronic module having a base portion, a column lens portion protruding from the base portion and a plurality of conductive pads; and an electrical connector comprising:

an insulative housing defining a receiving chamber encased by four walls thereof to receive the base portion of the electronic module and a rear wall at a rear of the receiving chamber;

a plurality of contacts retained in the insulative housing, each contact comprising a contact portion cantileveredly extending into the receiving chamber to touch the conductive pads of the electronic module; and at least one metal spring comprising a retaining portion retained in one of the four walls of the insulative housing and a pair of spring arms bending inwardly from an edge of the retaining portion, each spring arm comprising a distal end opposite to the edge of the retaining portion and protruding into the receiving chamber to abut against the electronic module; wherein an inner surface of one of the four walls defines a pair of recesses in communication with the receiving chamber for the pair of spring arms movable therein.

9. The electrical connector assembly according to claim 8, wherein the rear wall defining a plurality of passageways to secure the plurality of contacts.

10. The electrical connector assembly according to claim 8, wherein the four walls comprise a first side wall and a second side wall opposite to the first side wall, the first side wall defining a slit to receive the retaining portion of the metal spring.

11. The electrical connector assembly according to claim 10, further comprising another metal spring comprising another retaining portion retained in the second side wall and a pair of another spring arms bending from an edge of the another retaining portion, each another spring arm comprising a distal end opposite to the edge of the another retaining portion and protruding into the receiving chamber for elastically abutting against the electronic module.

12. The electrical connector assembly according to claim 8, wherein the electronic module comprises a circuit board with the plurality of conductive pads thereon, the circuit board being attached to a bottom side of the base portion, and wherein the base portion is substantially squared shaped and comprises a pair of locking plates on the bottom side thereof to abut against the distal ends of the spring arms.

13. The electrical connector assembly according to claim 8, wherein the pair of spring arms extend from opposite ends of the retaining portion.

14. An electrical connector assembly comprising:

an insulative upstanding housing defining a receiving cavity surrounded by a pair of opposite side walls and opposite top and bottom walls and a rear wall under a condition that said receiving cavity is forwardly open to an exterior;

a plurality of contacts disposed in the housing and having contacting portions extending into the receiving cavity, and tail sections extending below the corresponding contacting portions and protectively located under the bottom wall for mounting to a printed circuit board;

a metallic shield enclosing said housing and covering said opposite side walls and the top wall; and an electronic module assembled and received in the receiving cavity in a front-to-back direction; wherein a metallic resilient latching arm discrete from the shield, is assembled to one of said side walls of the housing and locking the electronic module in position in the receiving cavity; wherein said shield includes a pair of mounting legs around the bottom wall respectively.

15. The electrical connector assembly as claimed in claim 14, wherein said latching arm is electrically connected to the shield.

16. The electrical connector assembly as claimed in claim 14, wherein at least one post downwardly extend from the bottom wall.

17. The electrical connector assembly as claimed in claim 14, wherein said pair of mounting legs are respectively formed around two opposite side walls, and said tail sections are located between said pair of mounting legs.

18. The electrical connector assembly as claimed in claim 14, said contacting potions are arranged in only one row.

19. The electrical connector assembly as claimed in claim 14, wherein the electronic module defines a guiding groove extending along a front-to-back direction, so that the resilient latch arm is received in the guiding groove and abuts against the electronic module in both said front-to-back direction and a sideward direction.

20. The electrical connector assembly as claimed in claim 14, wherein said rear wall is dimensioned to be larger than the bottom wall.

* * * * *